US006546890B1

(12) United States Patent
Craig

(10) Patent No.: US 6,546,890 B1
(45) Date of Patent: Apr. 15, 2003

(54) BOAT HULL

(76) Inventor: David R. Craig, 10, Rue Mayet, 75006 Paris (FR)

( * ) Notice: Subject to any disclaimer, the term of this patent is extended or adjusted under 35 U.S.C. 154(b) by 0 days.

(21) Appl. No.: 09/695,251

(22) Filed: Oct. 24, 2000

(30) Foreign Application Priority Data

Aug. 18, 2000 (EP) ..... 00402309

(51) Int. Cl.[7] ..... B63B 1/22; B63B 1/32; B63B 1/00

(52) U.S. Cl. ..... 114/288; 114/283; 114/61.32

(58) Field of Search ..... 114/61.1, 61.2, 114/61.32, 61.33, 62, 271, 283, 288, 289, 290, 291

(56) References Cited

U.S. PATENT DOCUMENTS

| | | | | | |
|---|---|---|---|---|---|
| 3,177,836 | A | * | 4/1965 | Salamin | 114/61.2 |
| 3,342,154 | A | | 9/1967 | Le Marec | |
| D214,102 | S | * | 5/1969 | Rae | D12/311 |
| 3,807,337 | A | * | 4/1974 | English et al. | 114/288 |
| 3,902,445 | A | * | 9/1975 | Stolk | 114/289 |
| 4,924,797 | A | * | 5/1990 | Solia | 114/288 |
| RE33,359 | E | * | 10/1990 | Lang | 114/283 |
| 5,038,696 | A | * | 8/1991 | Athanasiou et al. | 114/289 |
| 5,078,072 | A | * | 1/1992 | Horiuchi et al. | 114/357 |
| 5,140,930 | A | * | 8/1992 | Lund | 114/291 |
| 5,655,473 | A | * | 8/1997 | Arvilla | 114/61.1 |
| D400,156 | S | * | 10/1998 | Duvenage et al. | D12/312 |
| 5,878,685 | A | * | 3/1999 | Hemohill et al. | 114/219 |

FOREIGN PATENT DOCUMENTS

| | | |
|---|---|---|
| EP | 0 298 051 | 1/1989 |
| EP | 0 352 195 | 1/1990 |
| EP | 0 359 825 | 3/1990 |
| EP | 0 775 626 | 5/1997 |
| FR | 2 490 579 | 3/1982 |
| NL | 11470 | 8/1924 |

* cited by examiner

*Primary Examiner*—Sherman Basinger
*Assistant Examiner*—Andy Wright
(74) *Attorney, Agent, or Firm*—Armstrong, Westerman & Hattori, LLP

(57) ABSTRACT

The hull has two lateral hull portions (5*a*, 5*b*) spaced part with respect to each other which each extends from a respective lateral wall of a front hull portion (1) beyond the rear end (1*a*) of the front hull portion (1). Lateral hull portions (5*a*, 5) are directly connected to a respective lateral wall of front hull portion (1). A respective tunnel (15*a*, 15*b*), open downwardly, is formed between the front hull portion (1) and each lateral hull portion (5*a*, 5*b*). Tunnels (15*a*, 15*b*) run into a further tunnel (15) defined behind the rear end (1*a*) of the front hull portion (1), between the lateral hull portions (5*a*, 5*b*).

9 Claims, 5 Drawing Sheets

BOAT HULL

FIELD OF THE INVENTION

The invention relates to a hull for a vessel having a shallow draft that is particularly adapted for power boats such as yachts among others. The invention relates also to a vessel comprising a hull according to the invention.

BACKGROUND OF THE INVENTION

Conventional monohulls are known in the prior art having a sharp front end and which widen towards their rear end which terminates perpendicular to the longitudinal axis of the hull. The sharp front end has a cross section having a general form of a "V".

Such hulls have several drawbacks. In particular, they have significant drag and draft, thus they need significant power in order to cruise at high speeds. They also have only a poor ability for crabbing, i.e. for moving in the lateral direction. They also have a hard drive in rough water as well as significant side rocking.

Catamarans also exist the particularity of which is to have two parallel and spaced apart longitudinal hulls connected together by transverse arms extending above the water surface. Similarly, trimarans also exist the particularity of which is to have a central longitudinal hull located between two lateral hulls in a spaced relationship and connected by respective transverse arms extending above the water surface.

Catamarans and trimarans also have drawbacks. In particular, they are likely to be affected by pitch polling, i.e. when the front of the hulls dives into a wave and becomes covered with water.

SUMMARY OF THE INVENTION

The object of the present invention is to alleviate the drawbacks of the prior art. In particular, the invention provides a hull having reduced draft, drag and weight characteristics with respect of hulls of the prior art having the same size, thus allowing to reach high speeds with smaller engines and with reduced fuel consumption.

DETAILED DESCRIPTION OF THE INVENTION

Figure 1:
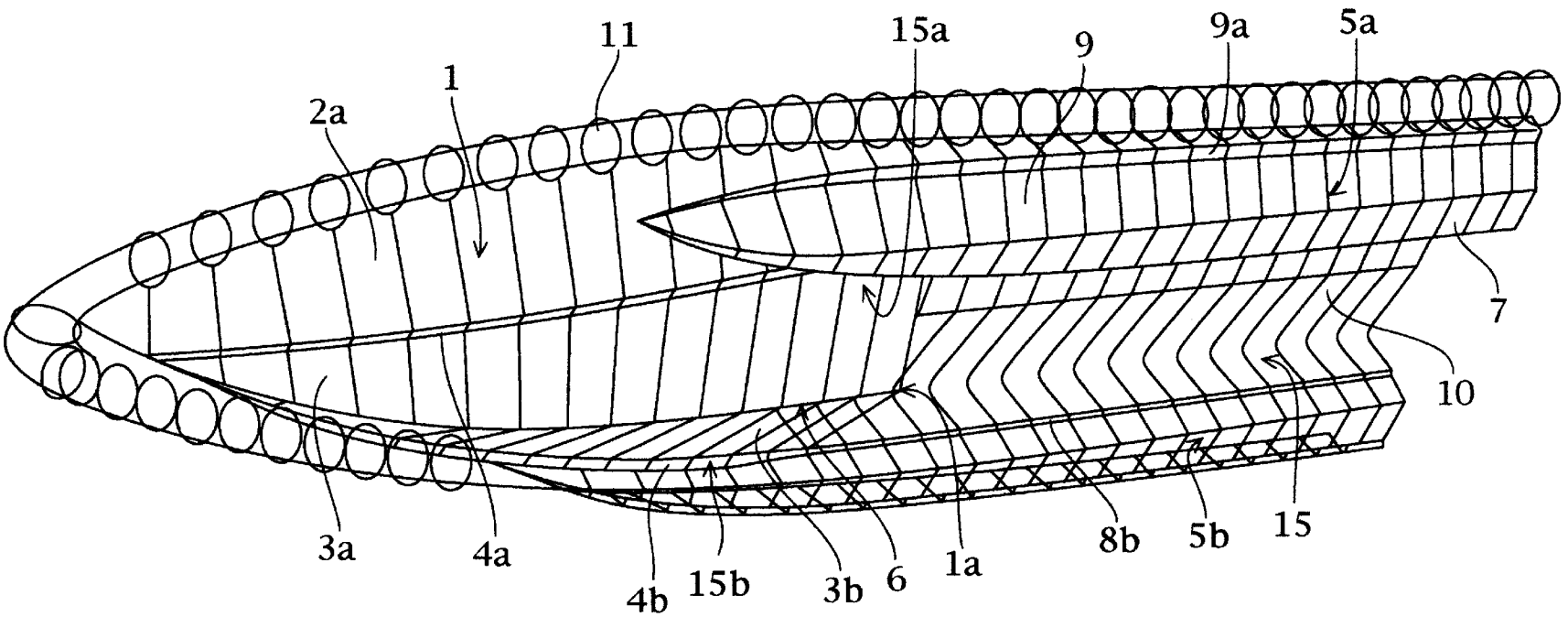
FIG. 1 is a perspective bottom view showing a hull according to a preferred embodiment of the invention.

The hull according to the invention has two lateral hull portions spaced apart with respect to each other which extend each from a respective lateral wall of a front hull portion beyond the rear end of the front hull portion.

The front hull portion may have the shape of any conventional monohull. The front hull portion has preferably the shape of a conventional monohull used for yachts. Nevertheless, the shape of the front hull portion may also be varied with respect of monohulls of the prior art.

The lateral hull portions extend each from a respective lateral wall of the front hull portion beyond the rear edge of the front hull portion. Each of the lateral hull portions is directly connected to the corresponding lateral wall of the front hull portion. Further, each of the lateral hull portions preferably protrudes downwardly from the lateral wall of the front hull portion.

As a result, a respective tunnel is defined between the front hull portion and each lateral hull portions. These tunnels extend substantially in the longitudinal direction. Hence, they constitute a passage for water and/or air in the longitudinal direction. They are open downwardly, preferably over their whole length. Each of these tunnels is preferably defined in the lateral directions and the upward direction by an uninterrupted wall. In particular, there is preferably no gap—or free passage—between each lateral hull portion and the front hull portion in the upward direction. These tunnels are at least partly—preferably totally—under the water surface when a vessel comprising the hull of the invention floats motionless in still water. In other words, when a vessel comprising the hull of the invention floats motionless in still water, water passes only around one hull instead of two hulls for conventional catamarans or three hulls for conventional trimarans. Further, an additional tunnel is defined between the lateral hull portions behind the rear end of the front hull portion. This additional tunnel also extends substantially in the longitudinal direction. The two previously-mentioned tunnels run each into this additional tunnel. The additional tunnel is advantageously larger than the width of the two previously-mentioned tunnels.

The cross section of the lateral hull portions may have the shape of the hulls of a conventional catamaran. Nevertheless, the shape of the cross section of the lateral hull portions may also be varied with respect of the hulls of catamarans of the prior art.

The hull is preferably symmetrically shaped with respect to a median vertical plane of the hull.

One will understand that the terms of "front", "rear" and "lateral" are defined with respect to the usual direction of motion of the hull.

A preferred embodiment will be described with reference to FIGS. 1 to 5.

All references to the water surface will correspond to the situation where the hull—or the vessel comprising the hull—floats motionless in still water.

The hull comprises a central front hull portion 1 and two lateral hull portions 5*a*, 5*b* extending each from a respective lateral wall 2*a*, 2*b* of the front hull portion 1. The hull is symmetrically shaped with respect to a median vertical plane.

Front hull portion 1 has a sharp front edge providing good penetration through water. Therefore, the longitudinal section—i.e. a section according to a plane parallel to the water surface—of front hull portion 1 has a general shape of a "V" with its tip towards the front end of the hull, regardless of the location height of the section plane. As a result, water is deflected smoothly along the lateral sides of front hull portion 1. This shape further allows to cut through the waves, thus giving good behavior through rough water.

The cross section—i.e. a section according to a plane perpendicular to the longitudinal direction Z—Z of the hull—of front hull portion 1 has also a general shape of a "V" with its tip oriented downwards, regardless of the longitudinal location of the section plane. The arms of said "V" become progressively longer as the considered section plane is located towards the rear of front hull portion 1. The tip of said "V" is located above the water surface at the very front end of front hull portion 1 and is progressively situated at lower levels—where the tip is then located under the water surface—when section planes are taken moving progressively towards the rear of front hull portion 1. More precisely, the tip of said "V" is located on a curve 6 which is inclined upwards with respect to the water surface when travelling from the rear end la towards the front end of front hull portion 1. Curve 6 corresponds to the lower line of front hull portion 1. One will understand that curve 6 is comprised in the median vertical plane of the hull.

The angle of a first part 6*a* of curve 6 with respect to the water surface is preferably comprised between 20 and 50 degrees. First part 6*a* corresponds to a first length along front hull portion 1 starting from its front end and measured along the median vertical plane of the hull. This first length is preferably comprised between 1/12 and 4/12 of the total length of front hull portion 1. The total length of front hull portion 1 is the longitudinal distance between the front end of the front hull portion 1 and its rear end 1*a* measured along the vertical median plane. When the rear edge 1*a* is not straight, the reference for measuring is the point of the rear edge 1*a* at the intersection with the water surface and the median vertical plane of the vessel of which the hull is a part.

The angle of a second part 6*b* of curve 6 with respect to the water surface is preferably comprised between 0 and 5 degrees. Second part 6*b* corresponds to a second length along front hull portion 1 which ends at the rear end 1*a* of front hull portion 1. Said second length—also measured along the median vertical plane of the hull—is preferably comprised between 4/12 and 7/12 of the total length of front hull portion 1. First part 6*a* of curve 6 links progressively second part 6*b*.

Each arm of the V-shaped cross section of front hull portion 1 is preferably broken so as to define two main portions. We will describe only one arm of the V-shaped cross section as the other one is symmetrically shaped with respect to the median vertical plane. A first portion 3*a* of the arm of the V-shaped cross section extends from curve 6 laterally away. The angle (x between first portion 3*a* and the water surface, i.e. the deadrise of front portion hull 1—is preferably comprised between 18 and 25 degrees and may advantageously take the value of 23 degrees—see FIG. 4. In the second part 6*b* of curve 6, first portion 3*a* preferably extends laterally—measured perpendicularly to the median vertical plane—between 1/6 and 2/6 of the total width of front hull portion 1, both being measured in a same cross section plane. A second portion 2*a* of the arm of the V-shaped cross section extends from the end of first portion 3*a* laterally away in the upward direction. The angle between second portion 2*a* and the water surface of the hull is preferably comprised between 50 and 70 degrees.

First portion 3*a* and its symmetrical portion 3*b* on the other side provide advantageously lift to the hull which increases with the speed of motion of the hull.

The rear end 1*a* of front hull portion 1—between lateral hull portions 5*a*, 5*b*—preferably extends perpendicular to the median vertical plane of the hull. Further, the rear end 1*a* of front hull portion 1 preferably extends perpendicular to the water surface.

Front hull portion 1 defines a front support on the water and therefore provides the hull with stability and avoids pitch polling. The fact that front hull portion 1 has a limited length with respect to the total length of the hull reduces the drag as friction of the hull on the water is reduced due to a low wetted surface compared to conventional monohulls.

We will now describe lateral hull portion 5*a*. Lateral hull portion 5*b* will not be described as it is symmetrical to lateral hull portion 5*a*.

Lateral hull portion 5*a* extends from a lateral wall of front hull portion 1 beyond the rear end 1*a* of front hull portion 1. Lateral hull portion 5*a* is directly connected—in an uninterrupted manner over their common length part—to the second portion 2*a* of front hull portion 1. Lateral hull portion protrudes downwardly from second portion 2*a*. As a result, a tunnel 15*a*—open downwardly—is defined between front hull portion 1 and lateral hull portion 5*a*. Tunnel 15*a* extends substantially longitudinally until the rear end 1*a* of front hull portion 1. As a further result, an additional tunnel 15 is defined between lateral hull portions 5*a*, 5*b* which extends longitudinally from the rear end 1*a* of front hull portion 1 up until the rear ends of lateral hull portions 5*a*, 5*b*. Tunnels 15*a*, 15*b* run into tunnel 15. As can be seen, tunnel 15 is larger than the width of tunnels 15*a*, 15*b*.

The front end of lateral hull portion 5*a* is located according to the longitudinal direction at a distance measured from the rear end 1*a* of front hull portion 1*a* which is preferably comprised between 1/3 and 1/2 of the total length of front hull portion 1.

Further, the front end of lateral hull portion 5*a* is located according to the longitudinal direction at a distance measured from the rear edge 1*a* of the front hull portion 1*a* which is preferably comprised between 0.2 and 0.3—advantageously 0.25—times the total length of lateral hull 5.

Lateral hull portion 5*a* has a sharp front edge providing good penetration through water. Therefore, similarly to front hull portion 1, the longitudinal section—i.e. a section according to a plane parallel to the water surface—of front hull portion 1 has preferably a general shape of a "V" with its tip towards the front end of the hull, regardless of the location height of the section plane.

The cross section—i.e. a section according to a plane perpendicular to the longitudinal direction Z—Z of the hull—of lateral hull portion 5*a* has also a general shape of a "V" with its tip oriented downwards as regards the portion located at the front end of lateral hull portion 5*a*. However, the cross section of lateral hull portion 5*a* rapidly changes into a kind of "U" shape. This is due to the fact that lateral hull portion 5*a* has preferably a substantially flat lower surface 7 which extends over its major length, with the exception of the sharp front edge portion which may correspond to about 1/5 of the length of lateral hull portion 5*a*. Flat lower surface 7 is preferably perpendicular to the median vertical plane of the hull. Further, flat lower surface 7 is preferably substantially parallel to the water surface, with the exception of the sharp front edge region.

Figure 4:
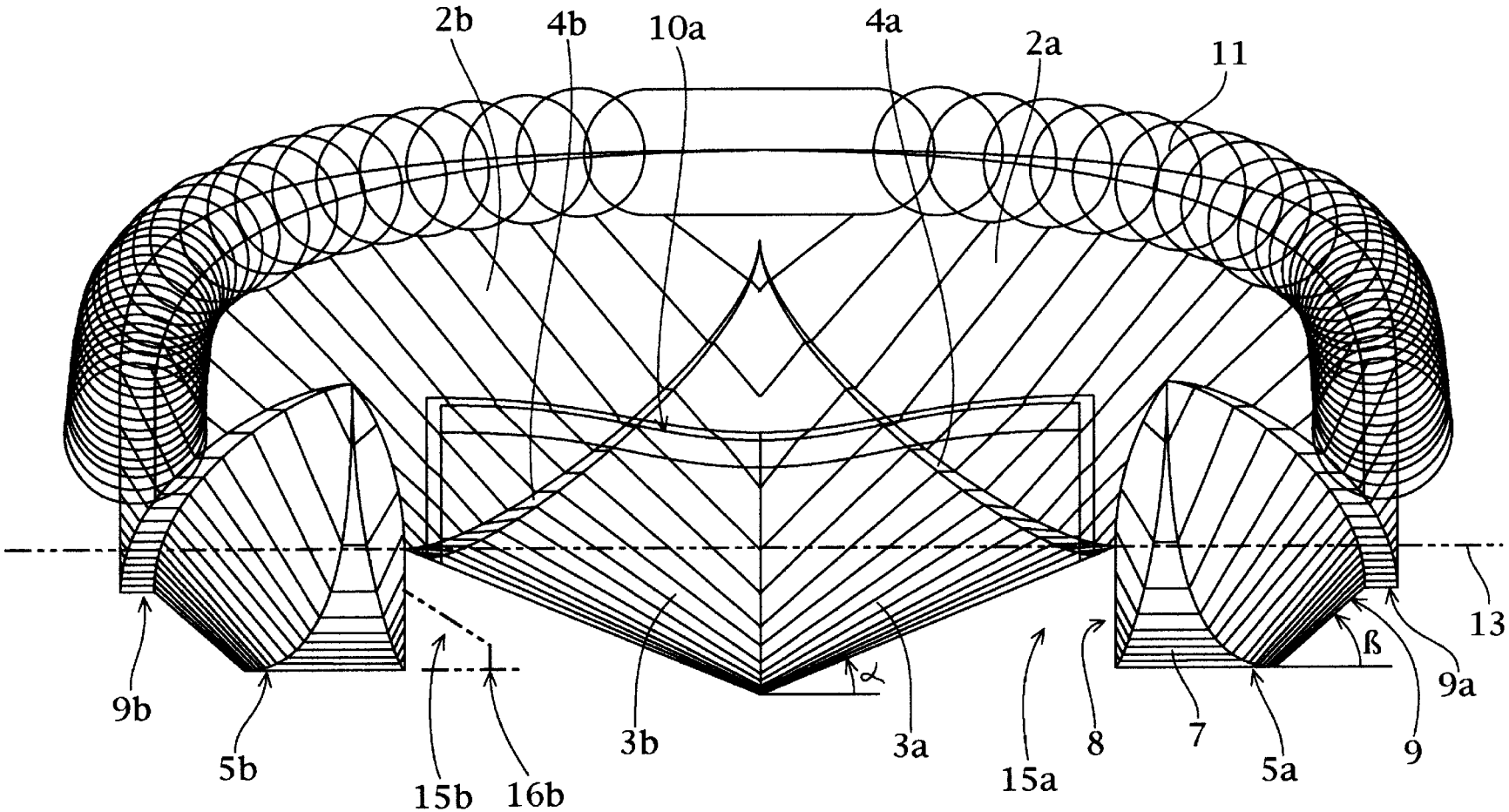
FIG. 4 shows a front view of the hull of FIG. 1.
Figure 5:
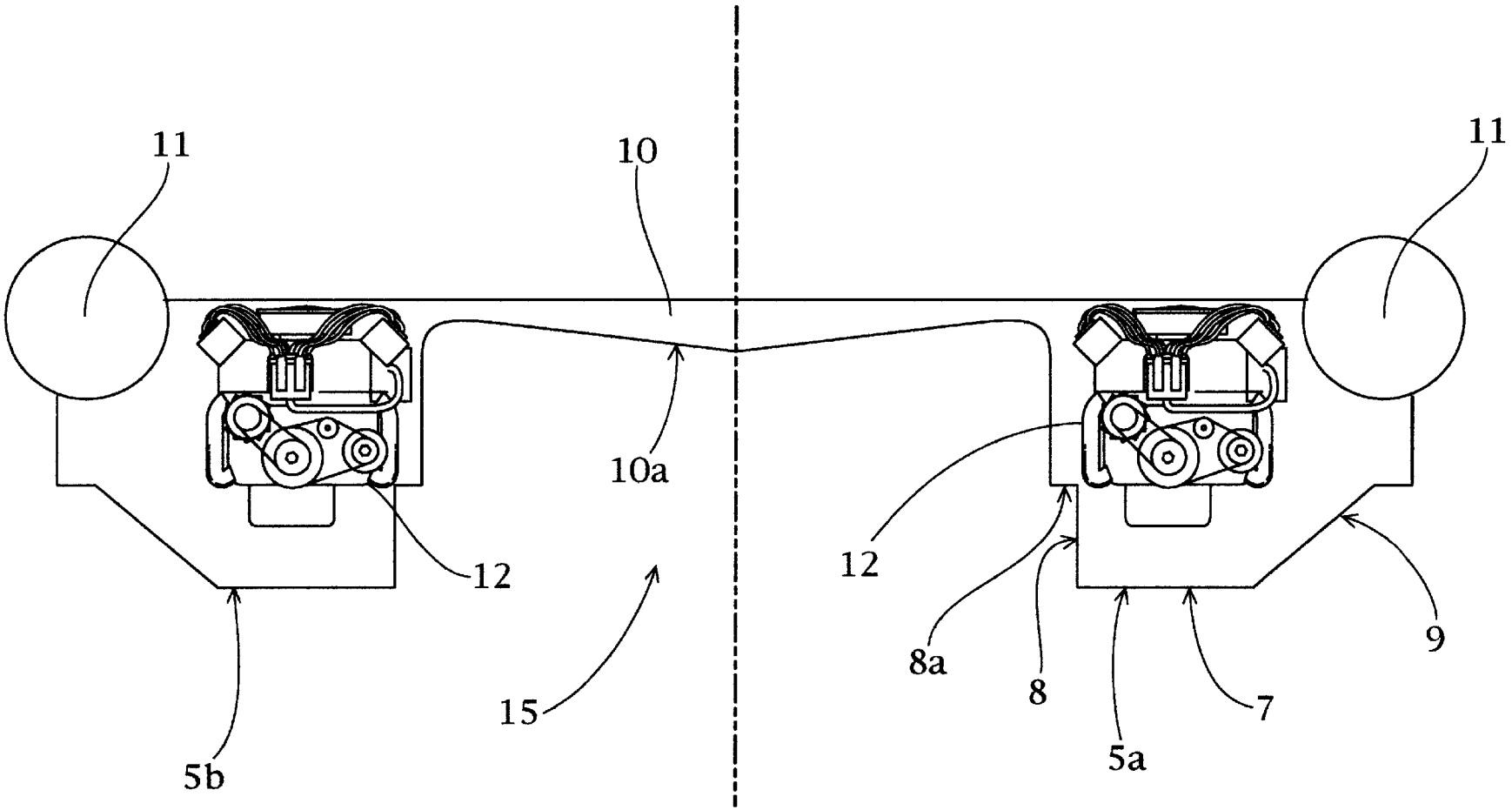
FIG. 5 shows a cross section through a rear portion of the hull of FIG. 1.

FIG. 5 illustrates the cross section of the hull according to a section plane located after the rear end 1*a* of front hull portion 1, more particularly, near the rear end of lateral hull portion 5*a*. As can be seen, the inner surface 8 of lateral hull portion 5*a* preferably extends substantially vertical. Inner surfaces 8 of lateral hull portions 5*a*, 5*b* define tunnel 15. On the contrary, as best seen in FIG. 4, the outer surface 9 is preferably inclined outwardly by an angle β with respect to the water surface—i.e. the deadrise of lateral hull portion 5*a*—comprised between 30 and 60 degrees—advantageously 45 degrees. The outer surface is inclined over preferably at least a quarter of the height of lateral hull portion 5*a*. The remaining part of outer surface 9 is located substantially at the same lateral level than portion 2*a* of front hull portion 1. Thus, said remaining portion of surface 9 corresponds to portion 2*a* at the rear end of front hull portion 1.

The cross section of lateral hull portion 5*a* is preferably substantially identical over its whole length, except in its front edge region. However, flat lower surface 7 becomes preferably larger progressively from the front region towards the end region. Lateral hull portion 5*a* extends preferably longitudinally, i.e. it extends in a straight manner beyond the rear edge 1*a* of front hull portion 1*a*.

The upper surface of lateral hull portion 5*a* is preferably flat and corresponds to the same vertical level than the deck of front hull portion 1.

The maximal width of lateral hull portion 5*a* is preferably comprised between 0.2 and 0.3—advantageously 0.25—times the breadth of beam of the hull—i.e. the maximal width of the hull.

Lower surface 7 is preferably located somewhat higher than the lowest point of curve 6 of front hull portion 1. At the cross section corresponding to the rear end 1*a* of front hull portion 1, lower surface 7 is preferably located at a vertical level which is intermediate between the lowest level and the highest level of portion 3*a* of front hull portion 1.

Lower surface 7 provides lift for the hull at high speed of motion of the hull. Thus, front hull portion 1 tends to be lifted out of the water and air passes under front hull portion 1 thereby providing supplemental lift. As a result, drag and draft of the hull are reduced. In fact, at high speeds—above about 80 km/h—, front hull portion 1 is lifted out of the water to a very large extent: only the rear part of front hull portion 1 remains in the water. In this situation, the wetted surface of the hull corresponds to about ⅛ of the wetted surface of a conventional monohull having the same length and breadth of beam and cruising at the same speed. Furthermore, the air passing under front hull portion 1—as well as water—flows through tunnel 15*a* and its symmetrical tunnel 15*b*, thus this air and water exert further forces on the hull surface defining tunnels 15*a*, 15*b* and provide extra lift. The lift provided by the air flowing through tunnels 15*a*, 15*b* becomes very significant when the speed of motion of the hull increases to speeds of 160 km/h and more. The air and water passing through tunnels 15*a*, 15*b* run then into tunnel 15. Tunnel 15 constitutes a free passage in the longitudinal direction Z—Z for this air and water, this passage being advantageously larger than tunnels 15*a*, 15*b*. Thus, there is practically no friction of this air and water in tunnel 15 as the surface of the hull defining tunnel 15 is limited to the inner walls 8 of lateral hull portions 5*a*, 5*b*. In other words, this air and water do not meet any resistance from the hull in tunnel 15.

Lateral hull portions 5*a* and 5*b* may advantageously locate towards their rear ends respective propulsion means 12, such as jet engines.

FIG. 4 shows the water surface level—referred to with reference numeral 13—corresponding to a vessel comprising the hull which floats motionless in still water. As can be seen, lateral hull portions 5*a*, 5*b* are partly in the water and partly protrude out of the water surface. The water surface is preferably located substantially at mid-height of lateral hull portions 5*a*, 5*b*, slightly above tunnels 15*a*, 15*b*.

Thanks to lateral hull portions 5*a* and 5*b*, the hull floats on a wide surface which provides a shallow draft even at low speeds or at standstill. Further, the rolling effect—i.e. the tendency of the hull to rotate around its longitudinal axis—is reduced with respect to conventional monohulls because of lateral hull portions 5*a*, 5*b* which are spaced apart.

In a particularly preferred embodiment, front hull portion 1 comprises a narrow surface 4*a* linking portion 2*a* to portion 3*a* of the V-shaped cross section. Surface 4*a* is parallel to the water surface or inclined downwards in the lateral direction with an angle preferably comprised between 0 and 30 degrees. Surface 4*a* further extends preferably between front hull portion 1 and lateral hull portion 5*a*, i.e. surface 4*a* defines the upper surface of tunnel 15*a*. Surface 4*a* also preferably extends along lateral hull portion 5*a* where it defines a shoulder referred to by reference numeral 8*a*—see FIG. 5. One will understand that front hull portion 1 comprises also a narrow surface 4*b* on its other side which is the mirror image of surface 4*a* with respect of the median vertical plane of the hull, narrow surface 4*b* further extending on lateral hull portion 5*b* as a shoulder 8*b*.

Similarly, the outer surface 9 of lateral hull portions 5*a*, 5*b* may also each comprise a respective shoulder 9*a*, 9*b*. Shoulders 9*a*, 9*b* extend preferably along the whole length of lateral hull portions 5*a*, 5*b*. Shoulders 9*a*, 9*b* are preferably flat and parallel to the water surface. Shoulders 9*a*, 9*b* may continue beyond the front edge of lateral hull portions 5*a*, 5*b* along both sides of front hull portion 1 up until the front edge of front hull portion 1, similarly to surfaces 4*a*, 4*b*.

Surfaces 4*a*, 4*b* and shoulders 8*a*, 9*a*, 8*b*, 9*b* respectively improve the breaking of water by front hull portion 1 and lateral hull portions 5*a*, 5*b*.

Figure 2:
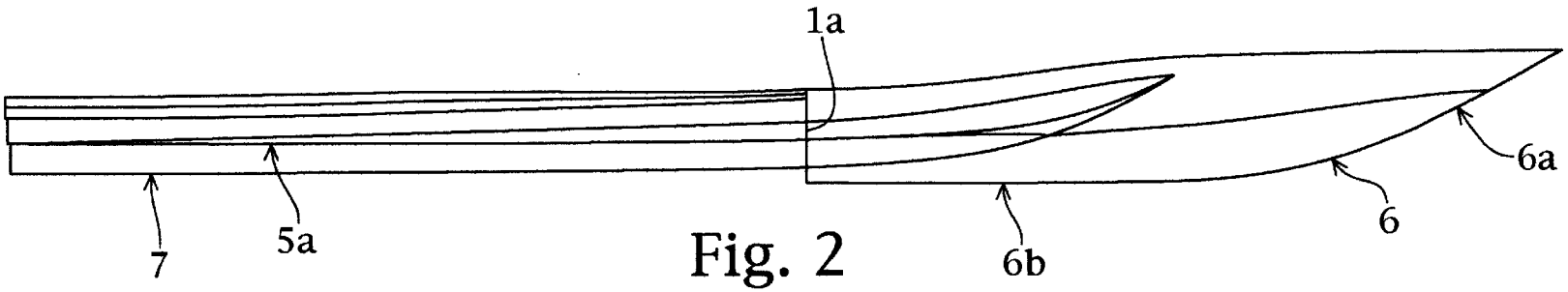
FIG. 2 shows a side view of the hull of FIG. 1.
Figure 3:
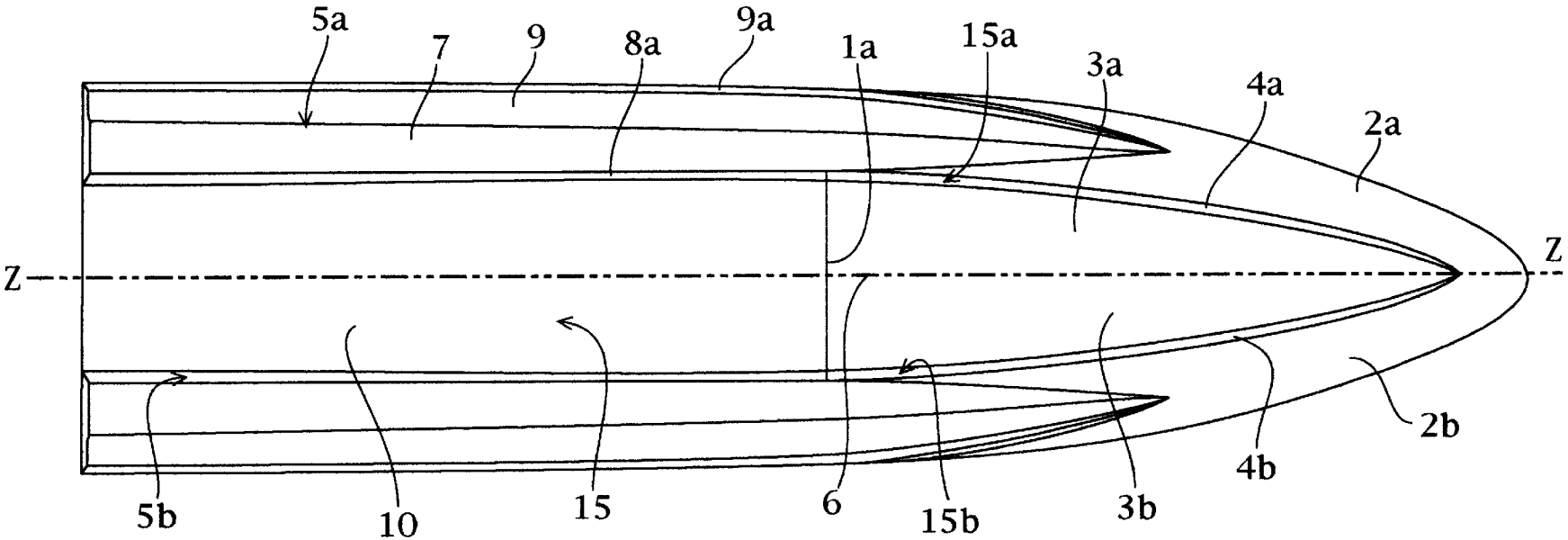
FIG. 3 shows a bottom view of the hull of FIG. 1.

In another particularly preferred embodiment, also illustrated by FIGS. 1 to 3, lateral hull portions 5*a* and 5*b* are linked together by a deck 10. Deck 10 extends at a distance over the water surface. Deck 10 extends from the rear end of lateral hull portions 5*a*, 5*b* to the rear end 1*a* of front hull portion 1 where it meets the deck of front hull portion 1. In other words, deck 10 extends above tunnel 15. Preferably, when the hull is in motion, there is substantially no friction of the air and water flowing through tunnels 15*a*, 15*b* on the lower surface of deck 10. Deck 10 links rigidly both lateral hull portions 5*a*, 5*b* to each other. For purpose of illustration, the lower surface 10*a* of deck 10 taken at the level of rear end 1*a* of front hull portion 1 is also represented in FIG. 4 although it is a front view of the hull in which it is normally not visible.

In another embodiment, also illustrated by FIGS. 1, 4 and 5, the hull comprises an air tube 11 extending along its upper edges from the front end of front hull portion 1 to the rear ends of each lateral hull portions 5*a*, 5*b*. Tube 11 is not represented in FIGS. 2 and 3. Tube 11 is preferably located substantially at the level of the water surface and is fastened to the hull. Tube 11 provides a volume with an overall density which is lower than the density of water. Thus, when a part of tube 11 is below the water, the latter exerts a lift on tube 11. When the hull is pitch polling, its front end tends to dive in the water. When the front end of the hull penetrates water, a front portion of tube 11 also penetrates water. The water then exerts a lifting force because of the overall lower density of tube 11. This means that the front end of tube 11 is pushed back, leading to the stabilization of the hull. Similarly, the side portions of tube 11 limit the rolling effect on the hull, as the water pushes back these portions when they penetrate the water. Alternatively, air tube 11 may be replaced by a rubber-filled tube having the same function.

In a further embodiment, the hull may further comprise hydrofoils. One hydrofoil 16*b* connected to lateral hull portion 5*b* is schematically shown—with dashes—in FIG. 4. One will understand that a second one is arranged symmetrically on lateral hull portion 5*a*. In the vertical direction, the lower surface of hydrofoil 16*b* is located below lower surface 7 of lateral hull portion 5*b*. Thus, at high speed, the hydrofoils slide on the water surface while lateral hull portions 5*a*, 5*b* are out of the water, thus the hull is furthermore lifted. In fact, in the vertical direction, the lower surface of hydrofoil 16*b* is advantageously located between lower surface 7 of lateral hull portion 5*b* and the lowest point of curve 6 of front hull portion 1. In the lateral direction, hydrofoil 16*b* preferably extends between lateral hull portion 5*b* and front hull portion 1. Thus, the hydrofoils are prevented from lugging solid elements which may be present in the water. Indeed, front portion 1 pushes such solid elements laterally away. However, the hydrofoils may also extend outwardly from lateral hull portion 5*b*.

Building materials of the hull of the invention may include usual materials like fiberglass, wood, steel, composites or aluminum. One will understand that a combination of these materials may be used. The hull is preferably built out of an aluminum alloy, advantageously a High Density Marine Grade Aluminum. Such a hull allows a corresponding vessel to go up on a beach or on any other inclined hard surface.

The hull may be fitted with any propulsion means known in the art, i.e. propeller drives, surface drives or surface piercing propellers. However, the use of jet drives is particularly preferred in view of safety consideration and low maintenance. Further, the reduced draft and drag allow some new kinds of motion, such as crabbing by suitably orienting the jet flows or other propulsion means to obtain such a transversal motion. The jet drives orientations may be controlled by a joystick placed on the control panel of the vessel.

Figure 6:
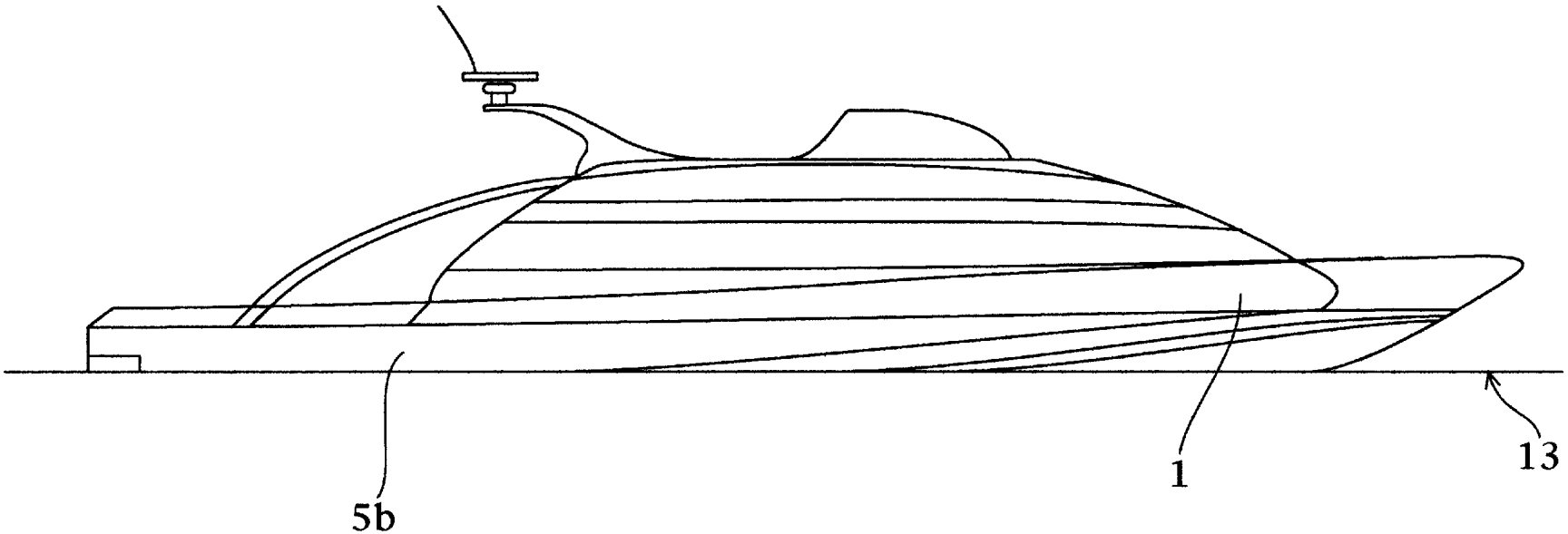
FIG. 6 shows a side view of a yacht based on the hull of FIG. 1.

For purpose of illustration, FIG. 6 shows a side view of a vessel in the form of a yacht having a hull according to FIGS. 1 to 5.

As an example of dimensions, a vessel with a hull according to the invention may take the form of a 27 meter long yacht, with a 7.5 meter breadth of beam, with a 0.9 meter draft, weighing 25 tons. This yacht may have a cruising speed of 40 km/h and can reach easily at least 85 km/h or even more, when provided with two 1300 horse power engines. At 85 km/h, the draft reduces to 0.5 m. Highest speed may of course be increased by using more powerful engines.

The invention was described with reference to preferred embodiments. However, many variations are possible within the scope of the invention. For instance, deck 10 may be replaced by one or several arms—extending above the water surface—linking both lateral hull portions 5*a*, 5*b* together to provide a rigid link there between. The front hull portion may also have a flat bottom wall—instead of having a V-shaped cross section corresponding to parts 3*a*, 3*b* forming an angle between them—in case the corresponding vessel is used in still water such as in lakes.

What is claimed is:

1. In a monohull vessel being a single hull having a front hull portion (1) and a pair of lateral hulls (5*a*, 5*b*), the lateral hulls being spaced apart from one another, the front hull portion forming a prow, the improvement comprising:

each lateral hull having a forward portion directly connected in an uninterrupted manner to the front hull portion, each lateral hull having a sharp front edge providing penetration through the water and a length extending therefrom, each lateral hull having a cross section changing from a V-shape oriented downwardly toward the water to a substantially U-shape segment having a flat lower surface, the front hull portion (1) having a rear end (1*a*) formed transversely of the lateral hulls and intermediately of the length of the lateral hulls, the front hull portion having a pair of arms (3*a*, 3*b*) forming a V-shape having an apex, the apex of the V of the front hull portion following a curved shape, the curve (6) being inclined upwardly from the surface of the water toward the prow of the vessel, wherein at lower speeds, the water is deflected smoothly along the arms of the V of the front hull portion, the curve (6*b*) progressively changing, becoming substantially parallel to and beneath the surface of the water at lower speeds and terminating at the rear end of the front hull portion, a tunnel being formed aft of the rear end of the front hull portion between the U-shape segments of the lateral hulls, such that as the vessel travels at lower speed through the water, the water is deflected outwardly from the V of the front hull portion, such that as the vessel travels at higher speed through the water, the U-shaped segments of the lateral hulls provide lift the front hull portion being substantially lifted out of the water and air passing under the front hull portion, water and air flowing through the tunnel with reduced friction thereby avoiding turbulence such that less power is required or more speed is obtained with existing power, such that the vessel has higher speed consonant with improved stability and maneuverability, and such that the vessel has the advantages of both a monohull vessel and a catamaran.

2. The monohull vessel according to claim 1, wherein each arm (3*a*, 3*b*) of the V-shaped portion of the front hull (1) is at an angle between 18° and 25° with respect to the water.

3. The monohull vessel according to claim 1, wherein at least one shoulder (4*a*, 4*b*, 8*a*, 8*b*) is formed thereon, the shoulder extending from the front hull portion (1) continuing interiorly on each of the lateral hull portions (5*a*, 5*b*), improving the breaking of water.

4. The monohull vessel according to claim 3, wherein the shoulder has a surface parallel to the water surface at a standing water line.

5. The monohull vessel according to claim 3, wherein at least one shoulder (9*a*, 9*b*) is formed exteriorly on each of the lateral hull portions.

6. The monohull vessel according to claim 1, wherein a respective tunnel (15*a*, 15*b*) is formed between the front hull portion (1) and each lateral hull portion (5*a*, 5*b*).

7. The monohull vessel according to claim 6, wherein the tunnels (15*a*, 15*b*) are open downwardly.

8. The monohull vessel according to claim 6, wherein the tunnels (15*a*, 15*b*) cooperate with the tunnel (15) formed aft the rear end (1*a*) of the front hull portion (1).

9. The monohull vessel according to claim 1, wherein the lateral hulls (5*a*, 5*b*) are connected by a deck (10), the deck, aft of the rear end (16) of the front hull portion (1), having a lower surface (10*a*), the lower surface having opposite end portions and a center portion, the center portion being closer to the water than the end portions, each of the opposite end portions being connected to the respective lateral hulls by an arcuate surface.

* * * * *